US005306218A

United States Patent [19]

Huang Chen

[11] Patent Number: 5,306,218

[45] Date of Patent: Apr. 26, 1994

[54] ROWING EXERCISER

[76] Inventor: Vincent Huang Chen, No. 137, Feng-Nien Rd., Feng-Yuan City, Taichung Hsien, Taiwan

[21] Appl. No.: 138,155

[22] Filed: Oct. 15, 1993

[51] Int. Cl.[5] ..... A63B 69/06; A63B 22/00

[52] U.S. Cl. ..... 482/72; 482/51; 280/1.182

[58] Field of Search ..... 482/72, 95, 96, 148, 482/66, 68, 51, 57, 73; 280/827, 828, 1.181, 1.182, 1.183, 1.191, 1.192, 1.201, 1.204

[56] References Cited

U.S. PATENT DOCUMENTS

| | | | |
|---|---|---|---|
| D. 218,624 | 9/1970 | Margolies | 482/72 |
| 2,017,213 | 10/1935 | Laborda | 280/1.182 |
| 2,978,258 | 4/1961 | Gabrielson | 280/1.182 |
| 4,886,287 | 12/1989 | Krause | 482/51 |
| 5,178,599 | 1/1993 | Scott | 482/96 |

*Primary Examiner*—Stephen R. Crow
*Attorney, Agent, or Firm*—Townsend and Townsend Khourie and Crew

[57] ABSTRACT

A rowing exerciser defined by pivotally connected elongated first and second frame members has a limit member fixed to one of the frame members posterior to the pivot point in order to limit up and down movements thereof, and a tension spring which connects the first and second frame members anterior to the pivot point. A downward front end of the first frame member is provided with a front wheel assembly, while the upward rear end of the former is provided with a seat. An upward front end of the second frame member is provided with a handle member, while a downward rear end of the same is provided with a rear wheel assembly. The front and rear wheel assemblies are rotatable in only one direction.

5 Claims, 4 Drawing Sheets

ROWING EXERCISER

BACKGROUND OF THE INVENTION

1. Field of the Invention

The invention relates to an exerciser, more particularly to a rowing-type body building exerciser for exercising the shoulder and arms.

2. Description of the Related Art

There are many types of body-building exercisers available in the market, such as chest pulls, barbells, shoulder presses, thigh & knee machines, pommel horses, and parallel bars, all of which are useful in their respective ways. However, an athlete cannot enjoy the pleasure of traveling while exercising simultaneously with the use of these body-building exercisers because he has to stay at the same place in order to use these exercisers. The athlete can get bored if he or she has to remain at the same place for a long period of time.

SUMMARY OF THE INVENTION

A main objective of the present invention is to provide a rowing-type exerciser for body-building which can enable an athlete to travel while exercising at the same time.

Accordingly, an athlete can exercise his shoulder and arms and can travel simultaneously at a relatively slow rate when using a rowing exerciser of the present invention. The rowing exerciser includes elongated first and second frame members connected pivotally to one another substantially at intermediate portion thereof. The first frame member has a downward front fork end which is provided with a front wheel assembly, and an upward rear end which carries a seat. The second frame member has an upward front end which is provided with a handle member and a downward rear end which carries at least one rear wheel assembly. The handle member is operable in a rowing mode in order to perform up and down movements of the second frame member relative to the first frame member.

A limit member is fixed to one of the first and second frame members adjacent to and posterior to a pivot point which is defined cooperatively by the former two. The limit member has an abutting face which is capable of abutting the other one of the first and second frame members to limit the up and down movements of the frame members.

A tension spring is used to connect the first and second frame members adjacent to and anterior to the pivot point under tension. The upward rear end of the first frame member and the downward rear end of the second frame member are pulled toward one another so that the abutting face of the limit member on one of the frame members abuts against the other one of the frame members.

The front and rear wheel assemblies are rotatable in a single direction. The rowing exerciser of the present invention will travel gradually when the handle member is operated up and down continuously.

In one preferred embodiment, a connecting shaft is fixed to the downward rear end of the second frame member and is transverse to an axis of the latter, and the rear wheel assembly includes two wheel units respectively mounted on two opposed ends of the connecting shaft. A user of this embodiment can operate the handle member up and down continuously so as to exercise his shoulder and arms while moving simultaneously with the exerciser in a forward direction.

In another preferred embodiment, the rear wheel assembly includes only one wheel unit, and a foot support rod is fixed to the downward front fork end of the first frame member. Two opposed ends of the foot support rod extend from two sides of the front wheel assembly to provide support for the feet of the user. The user of this embodiment must operate the handle member up and down continuously in addition to balancing the exerciser while traveling so as to prevent the rowing exerciser from collapsing to the ground. Thus, the user can practice balancing of the rowing exerciser in addition to performing exercise for his shoulder and arms.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENTS

Figure 1:
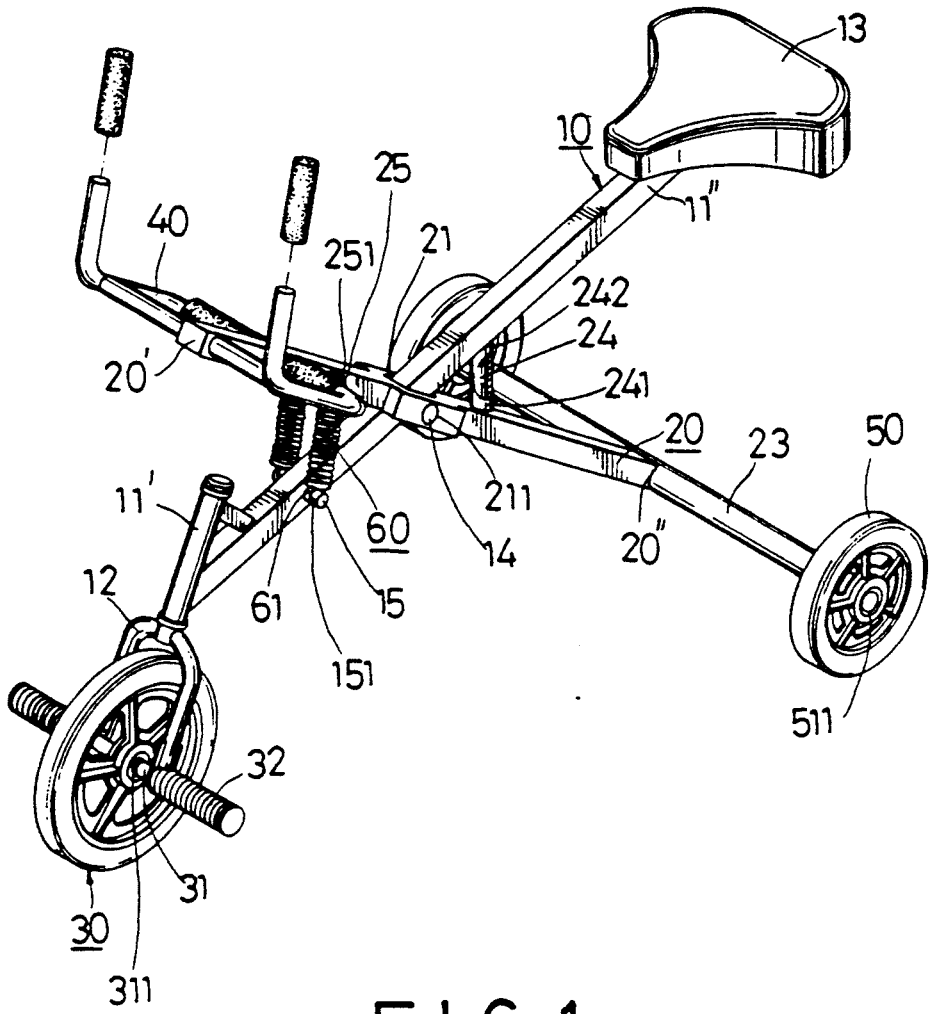
FIG. 1 shows a perspective, schematic view of the first preferred embodiment of a rowing exerciser of the present invention.
Figure 2:
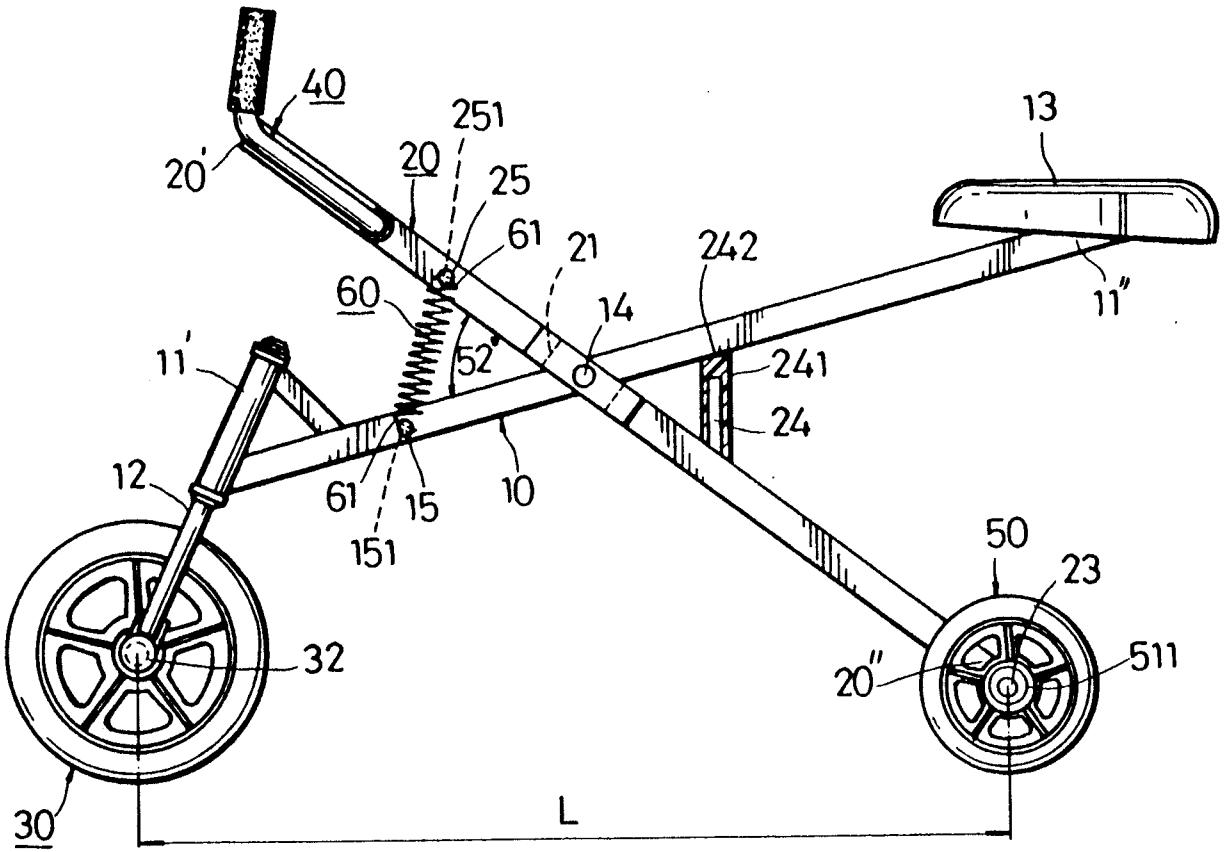
FIG. 2 shows a side view of the rowing exerciser of FIG. 1 before being operated.

Referring to FIG. 1, a rowing exerciser according to the present invention is shown to comprise an elongated first frame member 10 that has a through hole at an intermediate portion thereof, and an elongated second frame member 20 that has a rectangular connector 21 at an intermediate portion thereof. The rectangular connector 21 has two opposed beams 211 which extend parallel to an axis of the second frame member 20. Each of the opposed beams 211 has a through hole which is aligned with the through hole of the first frame member 10 when the latter is inserted through the connector 21 of the former. A fastening pin 14 extends through the through holes of the first and second frame members 10, 20, thereby connecting the first and second frame members 10, 20 pivotally.

The first frame member 10 has a downward front end 11' which carries a fork assembly 12, a pair of first engaging tabs 15 which are formed adjacent to the downward front end 11' and anterior to the pivot point of the first and second frame members 10, 20, and an upward rear end 11" with a seat 13. A front wheel assembly 30 is mounted on the fork assembly 12 and has a foot support rod 31 with two opposed ends that extend axially from two sides of the wheel assembly 30. Two treaded rubber sheaths 32 are sleeved respectively on the opposed ends of the foot support rod 31 to provide traction to the user's feet. The front wheel assembly 30 is provided with a unidirectional rotating hub 311, such as a hub with a ratchet backstop mechanism, around its axis. The hub 31 is supported fixedly by the fork assembly 12.

The second frame member 20 has an upward front end 20' with a handle member 40, a pair of second engaging tabs 25 which are formed adjacent to the upward front end 20' and anterior to the pivot point of the first and second frame members 10, 20, and a downward rear end 20". A connecting shaft 23 is fixed to the downward rear end 20" of the second frame member 20 and is transverse to an axis of the latter. The connecting shaft 23 has two opposed ends, each of which carrying a rear wheel assembly 50 and having a unidirectional rotating hub 511 around its axis. The structure of the hub 511 is similar to that of the hub 311 of the front wheel assembly 30.

A limit member, such as a support rod 24, is fixed to the second frame member 20, and a resilient sleeve 241 is sleeved slidably on the support rod 24. The resilient sleeve 241 has an abutting face 242 which is capable of abutting against the first frame member 10 when the handle member 40 of the second frame member 20 is operated up and down continuously in a rowing mode.

Each of a pair of tension springs 60 has two opposed hooks 61 respectively engaging the engaging holes 151, 251 in the first and second engaging tabs 15, 25 under tension, thereby pulling the upward rear end 11" of the first frame member 10 and the downward rear end 20" of the second frame member 20 toward one another. Under this condition, the abutting face 242 of the resilient sleeve 241 abuts against the first frame member 10, thereby forming a predetermined angle, such as 52 degrees, between the first and second frame members 10, 20. The up and down movement of the second frame member 20 is performed within the predetermined angle. A normal distance between the axes of the front and rear wheel assemblies 30, 50 is "L".

Figure 3:
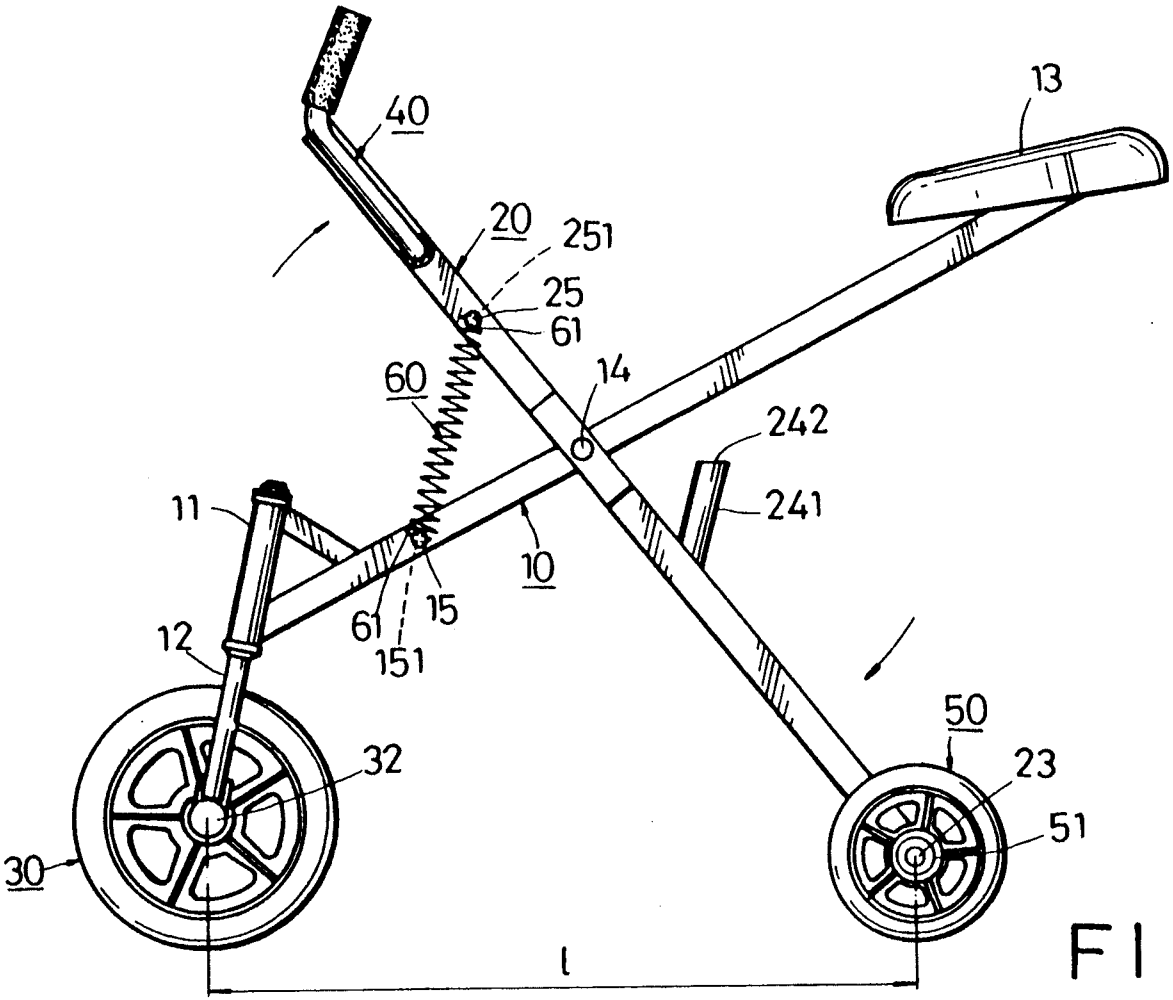
FIG. 3 shows a side view of the rowing exerciser of FIG. 1 in operation.

Referring to FIG. 3, the handle member 40 of the second frame member 20 is operated by pulling the same upward so as to pivot the former relative to the first frame member 10 at the fastening pin 14, in the direction indicated by the arrow. The downward rear end 20" of the second frame member 20 is pulled toward the front wheel assembly 30, thereby altering the distance between two axes of the front and rear wheel assemblies 30, 50 to a distance "1", which distance "1" being shorter than the distance "L". When the rear wheel assembly 50 moves toward the front wheel assembly 30, the front wheel assembly 30 does not move toward the rear wheel assembly 50 due to the provision of the hub 311.

When the pulling force at the handle member 40 at the upward front end 20' of the second frame member 20 is removed, the front wheel assembly 30 at the downward front end 11 of the first frame member 10 rotates forward due to the restoration force of the tension springs 60 and due to the weight of the user who is seated on the seat 13 of the second frame member 20. The forward movement of the front wheel assembly 30 stops when the abutting face 242 of resilient sleeve 241 abuts once more against the first frame member 10. Note that, when the front wheel assembly 30 moves in the forward direction, the second wheel assembly 50 is prevented from moving rearwardly due to the provision of the hub 511. Thus, the rowing exerciser of the present invention travels forwardly when the handle member 40 in the second frame member 20 is operated up and down repeatedly, thereby achieving the objective of exercising the shoulder and arms. The foot of the seated person can be disposed on the rubber sheaths 32 of the foot support rod 31 to guide the direction of the rowing exerciser.

Figure 4:
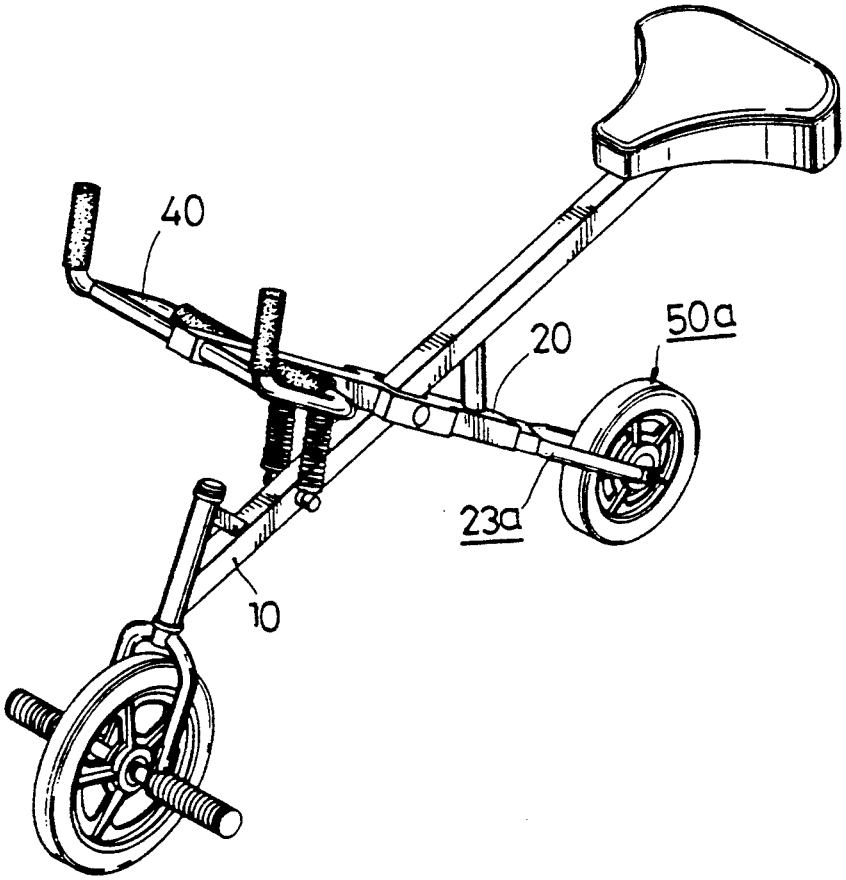
FIG. 4 shows a perspective, schematic view of the second preferred embodiment of the rowing exerciser of the present invention.

FIG. 4 shows the second preferred embodiment of a rowing exerciser according to the present invention. The main difference between the first and second preferred embodiments resides in that, for the second embodiment there is only one rear wheel assembly 50*a* fixed to a downward fork rear end 23*a* of the second frame member 20. The user of this embodiment must operate the handle member 40 of the second frame member 20 repeatedly in addition to balancing of the rowing exerciser while exercising. The objects and features are the same as the previous embodiment.

From the above description, it has been clearly shown that the rowing exerciser of the present invention is simple in construction and can provide some particular advantages, such as traveling and balancing, which the conventional body-building exercisers fail to achieve.

While preferred embodiments have been explained and described, it will be apparent that many changes and modifications can be made in the general construction and arrangement of the present invention without departing from the scope and spirit thereof. Therefore, it is desired that the present invention be not limited to the exact disclosure but only to the extend of the appended claims.

I claim:

1. A rowing exerciser comprising:

elongated first and second frame members connected pivotally to one another substantially at intermediate portions thereof, said first frame member including a downward front fork end which is provided with a front wheel assembly and an upward rear end which carries a seat, said second frame member having an upward front end which is provided with a handle member and a downward rear end which carries at least one rear wheel assembly, said front and rear wheel assemblies being single direction rotating wheel assemblies, said handle member being operable in a rowing mode in order to perform up and down movements of said second frame member relative to said first frame member;

a limit member fixed to one of said first and second frame members adjacent to and posterior to a pivot point which is cooperatively defined by said first and second frame members, said limit member having an abutting face to abut against remaining one of said first and second frame members to limit said up and down movements of said second frame member; and a tension spring connecting said first and second frame members adjacent to and anterior to the pivot point under tension, thereby pulling said upward rear end of said first frame member and said downward rear end of said second frame member toward one another to permit said abutting face of said limit member to abut against said remaining one of said first and second frame members.

2. The rowing exerciser as defined in claim 1, wherein said limit member further includes a resilient sleeve sleeved slidably thereon, said abutting face being formed on said resilient sleeve.

3. The rowing exerciser as defined in claim 1, further comprising a foot support rod fixed to said downward front fork end of said first frame member, said foot support rod having two opposed ends extending respectively and axially from two sides of said front wheel assembly.

4. The rowing exerciser as defined in claim 1, further comprising a connecting shaft connected securely to said downward rear end of said second frame member transverse to an axis of the later, said connecting shaft having two opposed ends, said rear wheel assembly including two wheel units respectively mounted on said two opposed ends of said connecting shaft.

5. The rowing exerciser as defined in claim 1, wherein said second frame member further includes a connecting member at said intermediate portion thereof, said connecting member being a rectangular frame with two opposed sides extending parallel to an axis of said second frame member, said first frame member extending through said rectangular frame to connect pivotally with said second frame member.

* * * * *